United States Patent [19]

Budd

[11] Patent Number: 4,585,091

[45] Date of Patent: Apr. 29, 1986

[54] APPARATUS FOR REPAIRING OR PROTECTING AN ENGINE EXHAUST SYSTEM

[76] Inventor: George V. Budd, Broadway, 108 Uxbridge Road, Harrow, Middlesex, England

[21] Appl. No.: 633,054

[22] Filed: Jul. 20, 1984

[30] Foreign Application Priority Data

| | | | |
|---|---|---|---|
| Aug. 4, 1983 | [GB] | United Kingdom | 8321075 |
| Sep. 23, 1983 | [GB] | United Kingdom | 8325551 |
| Nov. 10, 1983 | [GB] | United Kingdom | 8329951 |

[51] Int. Cl.[4] ..... F01N 7/18; B21D 53/00; B23P 6/00

[52] U.S. Cl. ..... 181/243; 24/274 R; 29/157 R; 29/402.02; 29/402.15; 29/402.18; 29/458; 29/527.2; 137/315; 138/99; 285/14; 403/313; 403/343; 403/344

[58] Field of Search ..... 29/157 R, 402.01, 402.02, 29/402.09, 402.14, 402.15, 402.18, 445, 458, 527.2, DIG. 1; 24/20 EE, 23 EE, 274 P, 274 R; 137/315; 138/97, 98, 99; 181/243; 285/15, 417, 418, 419, 422, 423, 424, 242, 252; 403/309, 312, 313, 343, 344; 285/253, 373, 14

[56] References Cited

U.S. PATENT DOCUMENTS

| | | | |
|---|---|---|---|
| 1,278,598 | 9/1918 | Cooper | 285/253 X |
| 1,360,311 | 11/1920 | Padgett | 181/243 |
| 2,107,588 | 2/1938 | Smith | 181/243 |
| 2,609,003 | 9/1952 | Kass | 138/99 |
| 2,946,395 | 7/1960 | Overland | 138/99 X |
| 2,966,226 | 12/1960 | Kalis | 138/99 X |
| 3,531,345 | 9/1970 | Torosian | 138/99 X |
| 3,737,959 | 6/1973 | Smith et al. | 24/279 |
| 4,202,379 | 5/1980 | Vetter | 138/99 |

FOREIGN PATENT DOCUMENTS

| | | | |
|---|---|---|---|
| 60426 | 4/1954 | France | 24/274 R |
| 1123890 | 6/1956 | France | 24/274 R |
| 178697 | 3/1962 | Sweden | 24/274 R |
| 526281 | 9/1940 | United Kingdom | 24/274 R |

*Primary Examiner*—Mark Rosenbaum
*Assistant Examiner*—Ronald S. Wallace
*Attorney, Agent, or Firm*—Shlesinger, Fitzsimmons & Shlesinger

[57] ABSTRACT

Apparatus for and a method of repairing or protecting an exhaust box or pipe of a motor vehicle are described. The apparatus comprises a flexible sheet having an outer stainless steel layer and an inner sealing layer. The flexible sheet is wrapped around the area of the exhaust box (or pipe) to be reinforced or repaired and secured in place with a Jubilee clip fastening arrangement attached to receiving members provided on the outer layer so that a seal is provided between the inner layer and the area to be protected or repaired.

6 Claims, 9 Drawing Figures

FIG 2
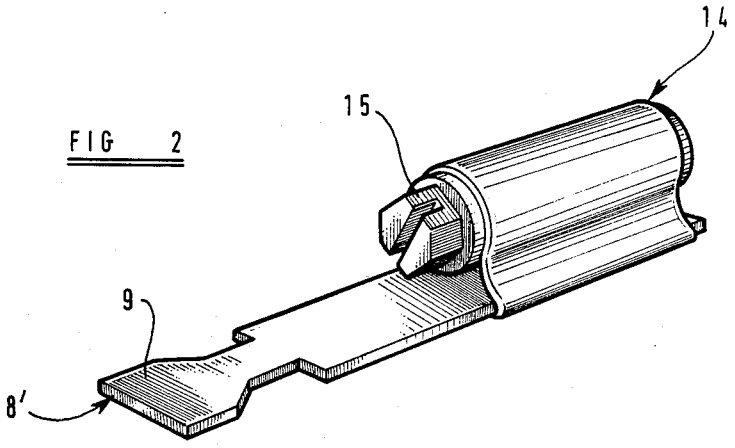
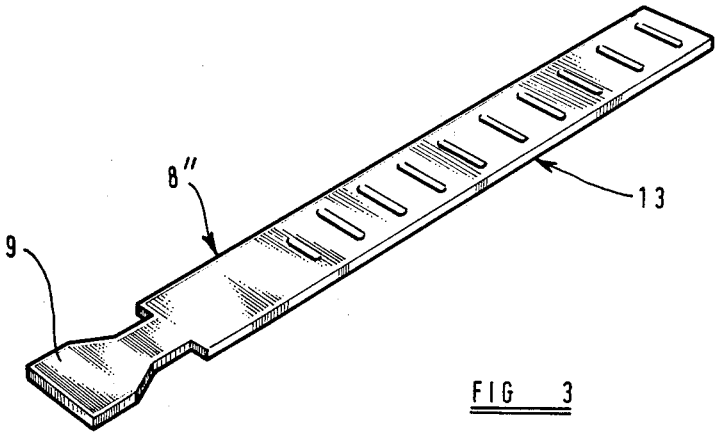
FIG 3

APPARATUS FOR REPAIRING OR PROTECTING AN ENGINE EXHAUST SYSTEM

BACKGROUND OF THE INVENTION

This invention relates to an apparatus for and a method of repairing or protecting the exhaust system of an internal combustion engine, such as a motor vehicle exhaust system.

In order to repair minor cracks or holes appearing in the exhaust system of an internal combustion engine, for example a motor vehicle exhaust system, a filling compound or sealant in the form of a settable paste is normally applied to the area of the exhaust box or pipe which has been damaged. Sometimes, after filling of the damaged area, a bandage made of a heat resistant material such as asbestos is wrapped round the damaged area to reinforce the repair. The pasty sealant or filling compound may, of course, be appied directly to the bandage rather than to the damaged area. The operations involved in carrying out such a repair are both time consuming and messy, particularly when the filling compound or bandage to which the filling compound has been applied are being handled.

OBJECT OF THE INVENTION

It is an object of the present invention to provide an apparatus for and a method of repairing the exhaust system of an internal combustion engine which overcome or at least mitigate the disadvantages of the above described methods.

SUMMARY OF THE INVENTION

According to one aspect of the present invention, there is provided apparatus for repairing or protecting an exhaust box or pipe in the exhaust system of an internal combustion engine, comprising a flexible sheet formed of a heat resistant material and fastening means for securing the flexible sheet in place when the sheet is wrapped around the exhaust box or pipe so that a seal is provided between the sheet and the exhaust box or pipe.

In a further apsect, the present invention provides, apparatus for repairing or protecting an exhaust box or pipe in the exhaust system of an internal combustion engine, comprising a flexible sheet formed of a heat resistant material and fastening means for securing the flexible sheet in place when the sheet is wrapped around the exhaust box or pipe so that a seal is provided between the sheet and the exhaust box or pipe, a portion of the flexible sheet extending along an edge thereof being formed so that, in use, the said portion conforms to changes in curvature of the pipe or box.

In another aspect, there is provided a method of repairing or protecting an exhaust box or pipe in the exhaust system of an internal combustion engine, comprising wrapping a flexible sheet of a heat resistant material around the exhaust box or pipe and securing the sheet in place using fastening means so that a seal is provided between the sheet and the exhaust box or pipe.

The present invention provides, in a further aspect, a fastening tie comprising first and second fastening member, at least one of the fastening members having one end shaped so as to be releasably received in a receiving member attached to a device with which the tie is to be used, the other ends of the first and second fastening members being adjustably connectable to one another.

Preferably, the fastening means is adjustable so that the flexible sheet may be used to reinforce or repair different sizes of exhaust boxes and/or pipes and, in one embodiment of the invention, the fastening means comprises one or more fastening devices and couping means on the sheet for the attachment of the or each fastening device.

The coupling means usually comprise first and second receiving members secured to the sheet adjacent respective ones of two edges of the sheet, which edges are opposed when the sheet is wrapped around an exhaust box or pipe and, in a preferred arrangement, the or each fastening device comprises first and second fastening members each having one end for engaging a respective one the first and second receiving members and means for adjustably connecting the other ends of the first and second fastening members. Conveniently, the one end of each first or second fastening member is shaped so as to be securely received in a corresponding recess of the first or second receiving member during use.

Generally, the fastening means comprises a fastening strip formed along the length thereof with a plurality of substantially parallel recesses or slots and a body for receiving the fastening strip, the body having a rotatable screw-threaded portion which engages the slots or recesses when the strip is received in the body so that, when the screw-threaded portion is rotated, the connection between the first and second fastening members is adjusted.

In a preferred embodiment, the flexible sheet is a laminate of two or more layers, at least the layer which in use of the apparatus contacts the exhaust box or pipe being formed of a sealing material so as to provide the seal between the sheet and the exhaust box or pipe when the sheet is secured in place.

Preferably, the layer of the laminated flexible sheet which in use of the apparatus is outermost from the exhaust box or pipe is formed of a metal, for example, a stainless or other steel.

The present invention provides, in a further aspect, a fastening tie comprising first and second fastening members, at least one of the fastening members having one end shaped so as to be releasably received in a receiving member attached to a device with which the tie is to be used, the other ends of the first and second fastening members being adjustably connectable to one another.

The present invention also provides a fastening device comprising first and second fastening members and a receiving member for attachment to a device with which the tie to be used, one of the fastening members having one end shaped so as to be releasably received in the receiving member when the receiving member is attached to a device with which the tie is to be used, the other ends of the first and second fastening members being adjustably connectable to one another.

BRIEF DESCRIPTION OF THE DRAWINGS

For a better understanding of the present invention, and to show how the same may be put into effect, reference will now be made, by way of example, to the accompanying drawings, in which:

FIG. 2 is a perspective view of a first type of fastening member for use with the flexible sheet;

FIG. 3 is a perspective view of a second type of fastening member for use with the flexible sheet;

DESCRIPTION OF PREFERRED EMBODIMENTS

Figures 1, 1A:
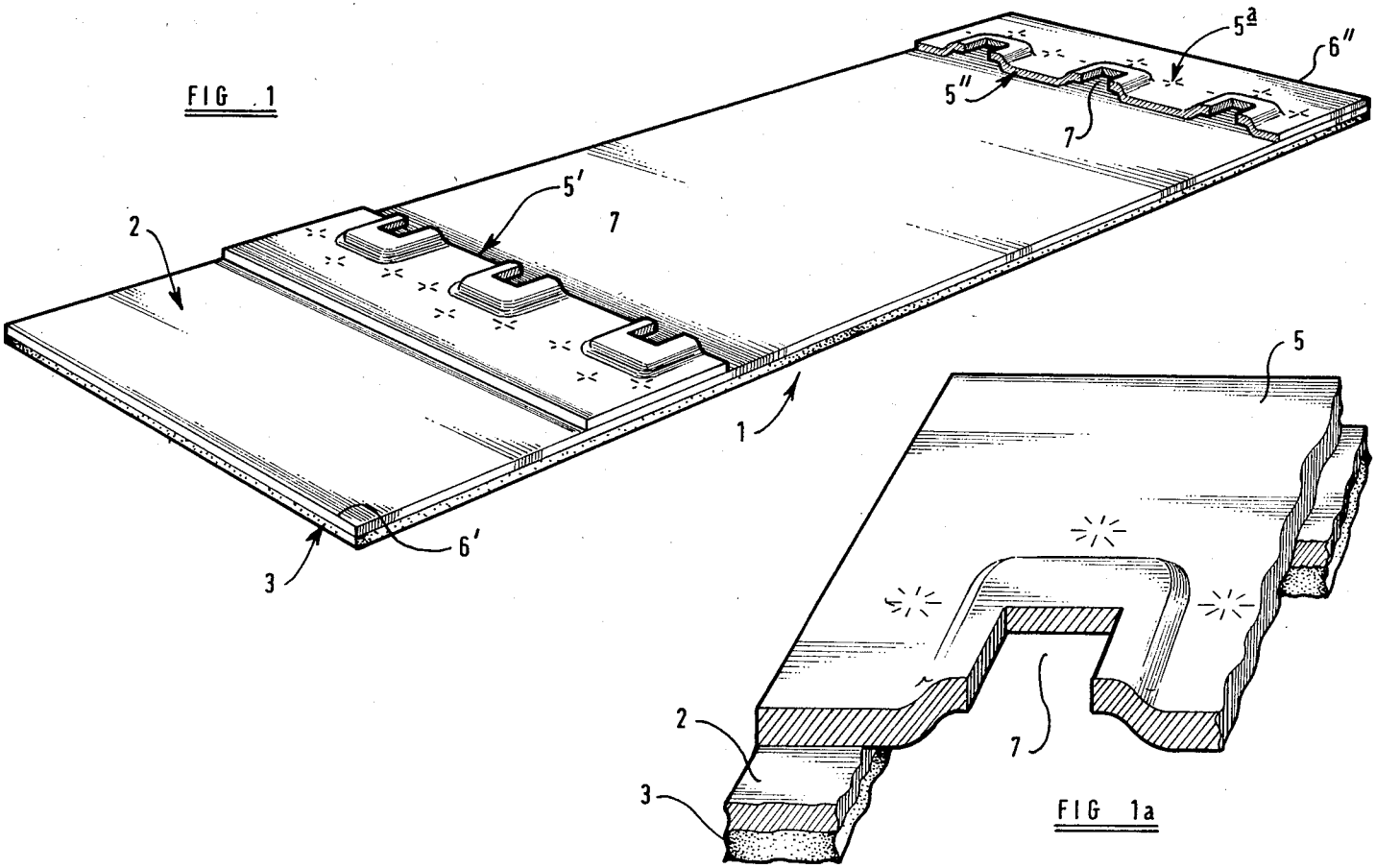
FIG. 1 is a perspective view of a flexible sheet of apparatus embodying the invention.
FIG. 1*a* is an enlarged view of part of the flexible sheet of FIG. 1 showing in detail part of a receiving member.

Referring now to the drawings, FIG. 1 shows a flexible elongate sheet 1 of apparatus embodying the invention for protecting or repairing an exhaust box or pipe in the exhaust system of an internal combustion engine.

The flexible sheet 1 is a laminate comprising an outer layer 2 and an inner, preferably resilient, sealing or gasket layer 3. The outer layer 2 is preferably formed of metal, in particular stainless steel plate having a thickness of from 0.005" to 0.008" (0.0127 mm to 0.203 mm) although any suitable heat resistant material having the required strength properties could be used. The sealing or gasket layer 3 may comprise a layer of compressed asbestos fibres (for example the material sold under the Trade name Uniline CAF), a layer of a similar alumino silicate fibrous material or any other suitable heat resistant material.

In use, the flexible sheet 1 is wrapped around an exhaust box or pipe and secured in place by a fastening means 4 (FIG. 5) which engages with coupling means in the form of two receiving members 5' and 5" secured to the outer layer 2 of the flexible sheet so that the inner layer 3 contacts and provides a seal with the area of the exhaust box or pipe around which the flexible sheet 1 is wrapped.

As shown in FIG. 1, the two receiving members 5' and 5" each comprise a stainless steel strip spot welded to 5*a* to the outer layer 2 of the flexible sheet so that each receiving member 5' and 5" is parallel to a respective one of the two shorter edges or ends 6' and 6" of the flexible sheet 1. One member 5" is positioned immediately adjacent to the end 6" of the sheet 1 while the other member 5' is spaced from the end 6' of the strip 1.

Figure 5:
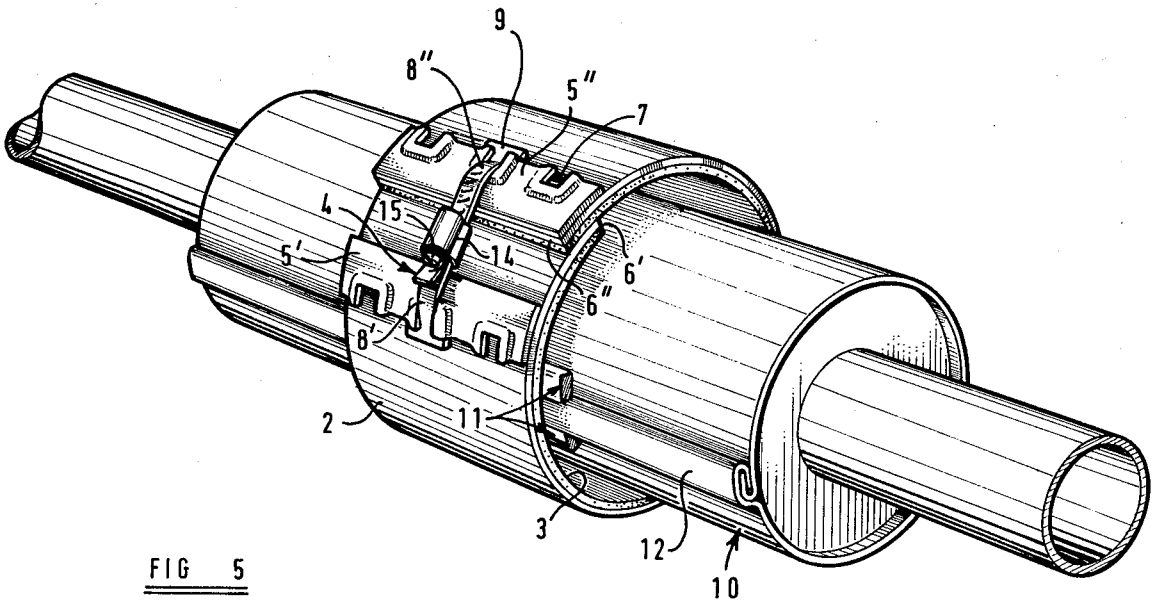
FIG. 5 is a perspective view of a motor vehicle exhaust system fitted with apparatus in accordance with the invention.

The fastening means 4 comprises a Jubilee (Registered Trade Mark) clip arrangement, although any other suitable fastening means could be used. Each receiving member 5' and 5" is formed with at least one shaped recess 7 to receive a complementarily shaped head 9 at one end of a respective fastening member or strip 8 as shown in FIG. 5. FIG. 1*a* is an enlarged view of part of the flexible sheet showing a recess 7. The complementarily shaped head 9 of each strip or fastening member is, as shown in FIGS. 2 and 3, formed by means of a neck or narrowed region in the strip.

FIG. 2 shows a fastening strip 8' for attaching a Jubilee clip body 14 to the receiving member 5' at the end 6' of the flexible sheet 1, while FIG. 3 shows a Jubilee strip 8" for attachment to the corresponding receiving member 5" at the other end 6" of the flexible sheet. The strip 8' has a specially shaped head at its other end which engages in the Jubilees clip body, while major part of the length 13 of the Jubilee strip 8" is formed in the usual manner with a plurality of indentations, each indentation extending transversely of the length of the strip for engagement with the thread of the screw 15 of the Jubilee clip body 14. Both fastening strips 8' and 8" are preferably made of stainless steel.

Figure 4:
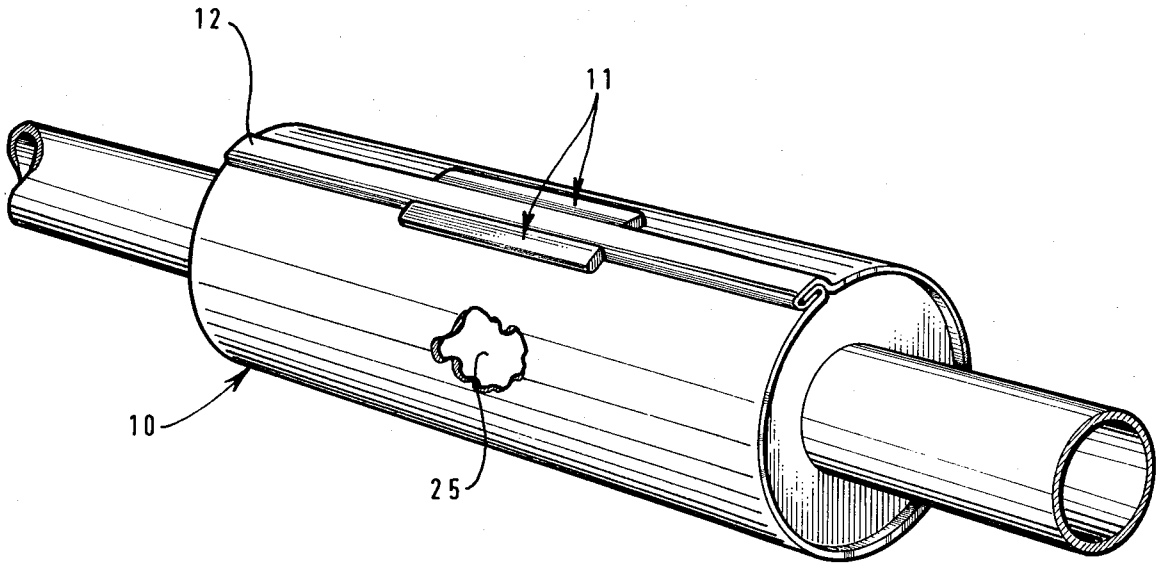
FIG. 4 is a perspective view of a motor vehicle exhaust system showing an initial step of a method embodying the invention.

In use of the apparatus to protect or repair an exhaust box 10 adhesive-backed sealing strips 11, if required, are first applied on either side of a raised seam 12 of the box 10 in the area to be protected or reinforced, as shown in FIG. 4. In the case shown in FIG. 4, the apparatus is being used to repair a hole 25 which has formed in the exhaust box. The sealing strips 11 may be formed of asbestos or other suitable heat-resistant material. The flexible sheet 1 is then wrapped round the area to be repaired or reinforced with the resilient layer 2 of the laminate innermost so that the flexible sheet extends right round the exhaust box and, as shown in FIG. 5, the ends 6' and 6" preferably partially overlap. The free, shaped head 9 of a fastening strip 8' is fitted into the middle recess 7 of the receiving member 5' at the one end of the flexible sheet 6' and the shaped head 9 of the Jubilee strip 8" is fitted into the corresponding recess 7 at the other end 6". The indented length of the Jubilee strip 8" is then introduced into the Jubilee clip body 14 and pulled tight by rotating the screw of the Jubilee clip body to ensure that a seal is provided between the inner layer 3 and the area being repaired. The free end of the strip 8" projecting from the Jubilee clip body 14 may be bent upwardly or twisted to secure the flexible sheet 1 in place so that it forms a jacket seal round the area being repaired. If required, further fastening means 4 can be attached to the other receiving members 5' and 5" to provide added strength.

As will be appreciated, an exhaust pipe can be protected or reinforced in a similar manner to that described above, without however there normally being any need for sealing strips 11.

Figure 6:
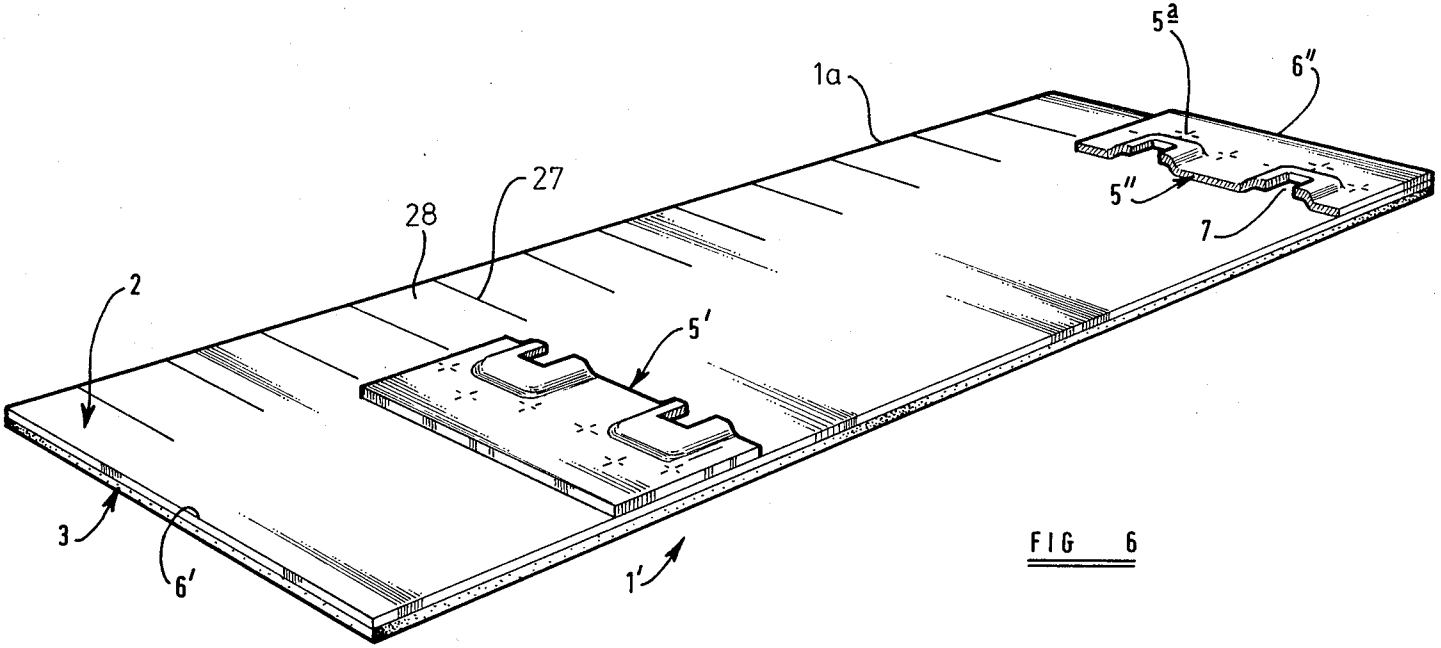
FIG. 6 is a perspective view of an alternative flexible sheet of apparatus embodying the invention.

FIG. 6 is a perspective view of an alternative flexible sheet of the apparatus which is intended for use where the exhaust system is to be repaired or reinforced at the junction between an end wall of the exhaust box and the exhaust pipe.

As shown in FIG. 6, the alternative flexible sheet 1' is substantially identical to the flexible sheet 1 shown in FIG. 1 and like parts in FIGS. 1 and 6 are identified by the same reference numerals. However in the arrangement shown in FIG. 6, the receiving members 5 do not extend across the centre width of the flexible strip but terminate at a distance from the longitudinal edge 1*a* of the sheet. The edge 1*a* of the sheet 1' is formed at regular intervals with slots or slits 27. The slits 27 define therebetween tabs 28 of approximately ⅛" (3.2 mm) in width and of approximately 1" (25 mm) in length although these dimensions may be varied depending upon the particular size of the exhaust system to be repaired or reinforced.

In use of the flexible sheet 1', a sealant or filling compound is first applied at least at the joint between the exhaust box and the flexible sheet 1'. The sheet 1' is then wrapped round the exhaust box and pipe and secured loosely with the fastening strip 8' and the Jubilee strip 8" shown in FIGS. 2 and 3 in the manner illustrated in FIG. 5 of the drawings. The sheet 1' is then pushed along the exhaust pipe toward the exhaust box so that the tabs 28 are forced to splay outwardly and form a flange which contacts the end wall of the exhaust box as shown schematically in FIG. 7 from which the Jubilee strip 8″ and fastening strip 8′ have been omitted in the interests of clarity.

Thus, the tabs 28 are secured to the exhaust box by the sealant enabling the repair or reinforcement to extend up to the joint between the pipe and the box thus further strengthening the exhaust system.

Of course, the tabs 28 would be bent outwardly from the remainder of the flexible sheet 1′ by hand before application of the sheet 1′ to the exhaust pipe rather than relying solely on the effect of pushing the flexible sheet 1′ against the exhaust box when the sheet is wrapped around the exhaust pipe. Further, although it may provide an added sealing effect, it is not necessary for the resilient layer 3 to extend further than the innermost end of the slits 27 so that the tabs 28 may, if desired, comprise merely the outer layer 2.

Figure 7:
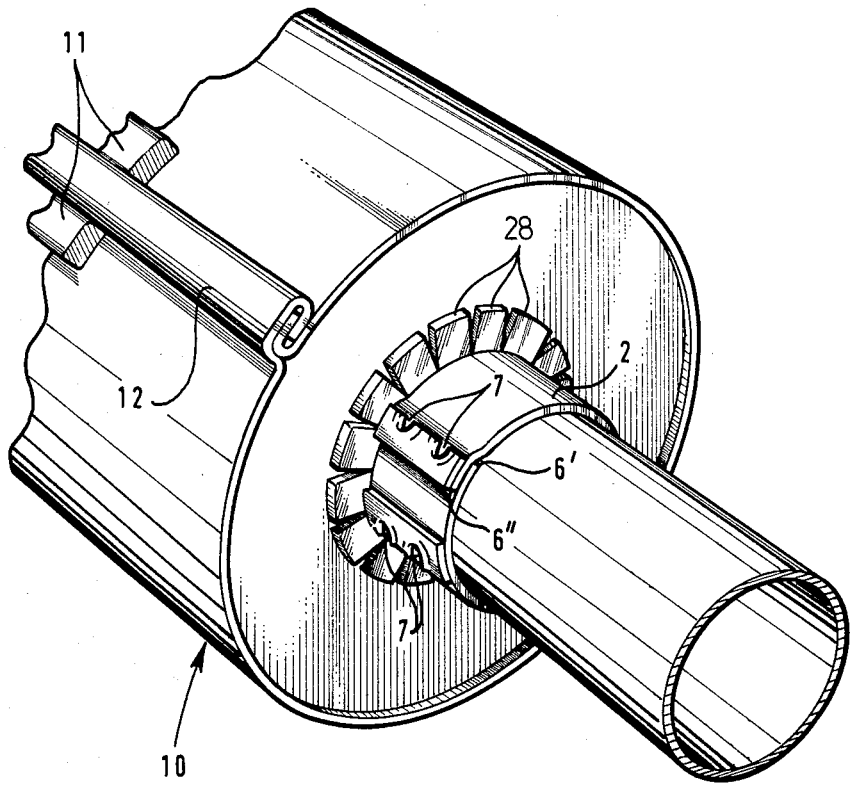
FIG. 7 is a schematic perspective view of a motor vehicle exhaust system fitted with the flexible sheet of FIG. 6, the fastening members being omitted.

When the tabs 28 have been pressed against the exhaust box end face as shown in FIG. 7, the Jubilee strip 8″ is pulled tight in the manner described above in relation to the arrangement shown in FIGS. 1 to 5 to ensure that a seal is provided between the inner layer 3 and the area of the exhaust pipe being reinforced or repaired.

Thus, apparatus embodying the invention not only allows any cracks or holes in the exhaust system to be sealed but also serves to reinforce the repaired area of the exhaust system, thereby minimising the risk of crack propagation or failure in areas adjacent to a damaged area. It is also envisaged that the apparatus could be applied as a protective measure to an undamaged area of an exhaust system, if desired, in order mechanically to reinforce the area in question or to protect it against the weather and other adverse external effects.

Figure 8:
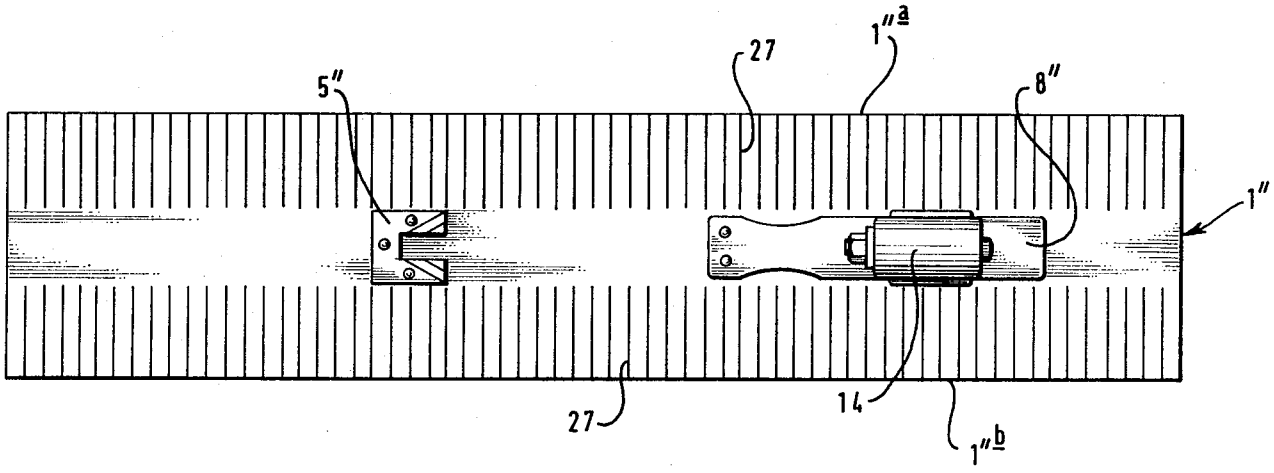
FIG. 8 is a plan view from above of another alternative flexible sheet for apparatus embodying the invention.

FIG. 8 shows another alternative flexible sheet 1″ which is similar to that shown in FIG. 6 except that, in the case of the sheet shown in FIG. 8, each of the elongate edges 1′*a* and 1′*b* of the sheet is formed at regular intervals with slots or slits 27. Also, in the arrangement shown in FIG. 8, the fastening strip 8′ carrying the Jubilee clip body 14 is fixed to the flexible sheet by, for example, spot welding. A single receiving member 5″ is provided on the flexible sheet 1″ to receive the shaped end 9 of the Jubilee clip 8″ (not shown in FIG. 8). The flexible sheet 1″ is particularly suited for use in repairing or reinforcing bends in pipes or other regions where there are changes in the curvature of the pipe. Where a sealant is used with the flexible sheet of FIG. 6 or 8, then no further fastening means may be necessary in order to secure the flanges formed by the slotted portions. It is, however, preferable, where possible, to provide additional fastening means, for example in the form of further Jubilee clip arrangements, to clamp the slotted edge portions on to the pipe being repaired or reinforced.

Whilst it is envisaged that the present application will find its main application in the repair and protection of the exhaust systems of internal combustion engines on mobile structures, such as motor vehicles or boats, the invention is of course equally applicable to the exhaust systems of static internal combustion engine installations, such as electrical generating sets.

Thus, in summary, the present invention provides apparatus for repairing or protecting an exhaust box or pipe in the exhaust system of an internal combustion engine, comprising a flexible sheet formed of a heat resistant material and fastening means for securing the flexible sheet in place when the sheet is wrapped round the exhaust box or pipe so that a seal is provided between the sheet and the exhaust box or pipe.

Preferably, the fastening means is adjustable so that flexible sheet may be used to reinforce or repair different sizes of exhaust boxes and/or pipes.

Usually, the fastening means comprises one or more fastening devices and coupling means on to the sheet for the attachment of the or each fastening device. In one preferred arrangement, the coupling means comprises first and second receiving members secured to the sheet adjacent respective ones of two edges of the sheet, which edges are opposed when the sheet is wrapped round an exhaust box or pipe and preferably the or each fastening device comprises first and second fastening members each having one end for engaging a respective one the first and second receiving members and means for adjustably connecting the other ends of the first and second fastening members. In another preferred arrangement, the coupling means comprises a receiving member secured to the sheet adjacent an edge of the sheet and, conveniently, the or each fastening device comprises first and second fastening members, one of the first and second fastening members having one end secured to the sheet adjacent an edge opposed to the said edge and the other of the first and second fastening members having one end shaped to releasably engage the receiving member and means are provided for adjustably connecting the other ends of the fastening members.

Generally, for the or each fastening device, the one end of the one fastening member or the one end of each member is shaped so as to be securely received in a corresponding recess of the first or second receiving member during use. Conveniently, the first fastening member comprises a fastening strip formed along the length thereof with a plurality of substantially parallel recesses or slots and the second fastening member comprises a body for receiving the fastening strip, the body having a rotatable screw-threaded portion which engages the slots or recesses when the strip is received in the body so that, when the screw-threaded section is rotated, the connection between the first and second fastening members is adjusted.

The present invention also provides apparatus suitable for repairing or protecting an exhaust box or pipe in the exhaust system of an internal combustion engine, comprising a flexible sheet formed of a heat resistant material and fastening means for securing the flexible sheet in place when the sheet is wrapped round the exhaust box or pipe so that a seal is provided between the sheet and the exhaust box or pipe, the fastening means comprising first and second fastening members, the first fastening member comprising a fastening strip formed along its length with a plurality of substantially parallel recesses or slot and the second fastening member comprising a body for receiving the fastening strip, the body having a rotatable screw-threaded portion which engages the slots when the fastening strip is received in the body so that, when the screw-threaded portion is rotated, the connection between the first and second fastening members is adjusted.

Preferably, the flexible sheet is a laminate of two or more layers, at least the layer which in use of the apparatus contacts the exhaust box or pipe being formed of a sealing material so as to provide the seal between the sheet and the exhaust box or pipe when the sheet is secured in place and usually the layer of the laminated flexible sheet which in use of the apparatus is outermost from the exhaust box or pipe is formed of a metal which may be stainless steel. A portion of the flexible sheet extending along an edge of the sheet may be formed so that, when the flexible sheet is wrapped round an exhaust pipe at a position adjacent the exhaust box and secured in place, the said portion of the flexible sheet forms a flange extending in contact with an end face of the exhaust box.

In a further aspect, the present invention provides apparatus for repairing or protecting an exhaust box or pipe in the exhaust system of an internal combustion engine, comprising a flexible sheet formed of a heat resistant material and fastening means for securing the flexible sheet in place when the sheet is wrapped round the exhaust box or pipe so that a seal is provided between the sheet and the exhaust box or pipe, a portion of the flexible sheet extending along an edge thereof being formed so that, in use, the said portion conforms to changes in curvature of the pipe or box.

Normally, a portion of the edge of the flexible sheet opposite the said edge is also formed so as to conform to changes in curvature in use of the apparatus. Preferably, the or each said portion is formed with a plurality of slots, each slot extending transversely of the said edge to form a plurality of tabs arranged along the edge, which tabs conform to changes of curvature when the flexible sheet is secured in place in use of the apparatus and conveniently, the or each said portion of the flexible sheet is formed only by the layer of the laminate flexible sheet which, when the sheet is wrapped round the exhaust pipe, is outermost.

The apparatus may also comprise one or more adhesive heat resistant sealing strips for securement adjacent a raised seam on an exhaust box to ensure that a seal is provided when the sheet is wrapped round the exhaust box and secured in place.

The invention further provides a method of repairing or protecting an exhaust box or pipe in the exhaust system of an internal combustion engine, comprising wrapping a flexible sheet of a heat resistant material around the exhaust box or pipe and securing the sheet in place using fastening means so that a seal is provided between the sheet and the exhaust box or pipe. Conveniently, a sealant is applied to at least the joint between an exhaust box and an exhaust pipe prior to wrapping the flexible sheet round an exhaust pipe adjacent the exhaust box and the sheet is secured in place such that a portion thereof extending along an edge of the sheet forms a flange in contact with an end face of the exhaust box and one or more adhesive heat resistant sealing strips may be applied to an exhaust box adjacent a raised seam on the exhaust box prior to wrapping the flexible sheet round the exhaust box.

In a preferred arrangement wherein the fastening means comprises one or more fastening devices, and the or each fastening device comprises first and second fastening members, the step of securing the sheet in place comprises, for each fastening member, engaging one end of each of the first and second fastening members in a respective receiving member secured to the sheet adjacent a respective edge thereof, connecting together the other ends of the first and second fastening members and adjusting the connection between the first and second fastening members to secure the sheet in place. Usually, the connection between the other ends of the first and second fastening members is provided by a separate connection member.

The invention also provides a fastening tie comprising first and second fastening members, at least of the fastening members having one end shaped so as to be releasably received in a receiving member attached to a device with which the tie is to be used, the other ends of the first and second fastening members being adjustably connectable to one another. Generally, one end of each of the first and second fastening members is shaped so as to be releasably received in a respective receiving member attached to the device with which the tie is to be used.

In another aspect, the invention provides a fastening device comprising first and second fastening members and a receiving member for attachment to a device with which the tie is to be used, one of the fastening members having one end shaped so as to be releasably received in the receiving member when the receiving member is attached to a device with which the tie is to be used, the other ends of the first and second fastening members being adjustably connectable to one another. Preferably, a further receiving member is provided for attachment to a device with which the tie is to be used and the one end of the first and second fastening members is shaped so as to be releasably received in the further receiving member and, conveniently, the first fastening member comprises a fastening strip formed along its length with a plurality of substantially parallel recesses or slots and the second fastening member comprises a body for receiving the fastening strip, the body having a rotatable screw-threaded portion for engaging the slots or recesses so that, when the strip is received in the body and the screw-threaded portion is rotated, the connection between the first and second fastening members is adjusted.

Although a particular embodiment of the invention has been described, it is recognised that modifications may readily occur to those skilled in the art and consequently it is intended that the following claims be interpreted to cover such modifications and equivalents.

What is claimed is:

1. Apparatus suitable for repairing or protecting an exhaust box or pipe in the exhaust system of an internal combustion engine, comprising a flexible sheet formed of a heat resistant material and fastening means for securing the flexible sheet in place when the sheet is wrapped round the exhaust box or pipe so that a seal is provided between the sheet and the exhaust box or pipe, the fastening means comprising first and second fastening members, the first fastening member comprising a fastening strip formed along its length with a plurality of substantially parallel recesses or slots and the second fastening member comprising a body receiving the fastening strip, the body having a rotatable screw-threaded portion which engages the slots when the fastening strip is received in the body so that, when the screw-threaded portion is rotated, the connection between the first and second fastening members is adjusted.

2. Apparatus according to claim 1 wherein the flexible sheet is laminate of two or more layers, at least the layer which in use of the apparatus contacts the exhaust box or pipe being formed of a sealing material so as to provide the seal between the sheet and the exhaust box or pipe when the sheet is secured in place.

3. Apparatus for repairing or protecting an exhaust box or pipe in the exhaust system of an internal combustion engine, comprising a flexible sheet formed of a heat resistant material and fastening means for securing the flexible sheet in place when the sheet is wrapped around the exhaust box or pipe so that a seal is provided between the sheet and the exhaust box or pipe, a portion of the flexible sheet extending along one edge thereof being formed with a plurality of slots, each slot extending transversely of said edge to form a plurality of tabs arranged along the edge, which tabs conform to changes of curvature when the flexible sheet is secured in place when the apparatus is used on the pipe or box.

4. Apparatus suitable for repairing or protecting an exhaust box or pipe in the exhaust system of an internal combustion engine, which apparatus comprises: a flexible sheet having first and second ends, the flexible sheet being formed of a heat resistant material; and fastening means for securing the flexible sheet in place when the sheet is wrapped around the exhaust box or pipe so that a seal is provided between the sheet and the exhaust box or pipe, the fastening means comprising first and second fastening members, the first fastening member comprising a fastening strip having a shaped first end and a second end and being formed along its length with a plurality of substantially parallel recesses or slots, and the second fastening member comprising a body for receiving the fastening strip, the body carrying a connecting member having a shaped end and the body having a rotatable screw-threaded portion which engages the slots when the fastening strip is received in the body so that, when the screw-threaded portion is rotated, the connection between the first and second fastening members is adjusted, a first receiving member being secured to the flexible sheet adjacent the first end thereof for releasably receiving said first shaped end of the fastening strip and a second receiving member secured to the flexible sheet adjacent the second end thereof for releasably receiving the shaped end of the connecting member.

5. Apparatus suitable for repairing or protecting an exhaust box or pipe in the exhaust system of an internal combustion engine, comprising:

a flexible heat-resistant sheet having first and second ends, the sheet being in the form of a laminate having an outer and an inner layer, the outer layer being formed of metal and the inner layer which in use of the apparatus contacts the exhaust box or pipe being formed of a gasket material; and fastening means for securing the flexible sheet in place when the sheet is wrapped around the exhaust box or pipe so that a seal is provided between the sheet and the exhaust box or pipe, the fastening means comprising:

first and second fastening members, the first fastening member comprising an elongate fastening strip having a first end and a second end and being formed along its length with a plurality of substantially parallel recesses or slots, and the second fastening member comprising a body for receiving the fastening strip, the body having a rotatable screw-threaded portion which engages the slots when the fastening strip is received in the body and the body carrying an elongate connection member having a free end extending from the body, the free end of the elongate connection member and the first end of the fastening strip each being shaped so as to have a narrow neck portion defining a relatively large end portion;

a first receiving member in the form of a metal plate secured to the outer layer of the flexible sheet adjacent one end thereof, the first metal plate having a cut-out portion extending away from the first edge of the flexible sheet, the cut-out portion having first and second opposed edge portions which are raised to define a recess for receiving the end portion of the fastening strip; and a second receiving member in the form of metal plate secured to the outer layer of the flexible sheet adjacent the other end thereof, the second metal plate having a cut-out portion extending away from the second edge of the flexible sheet, the cut-out portion having first and second opposed edge portions which are raised to define a recess for receiving the end portion of the connection member.

6. Apparatus suitable for repairing or protecting an exhaust box or pipe in the exhaust system of an internal combustion engine, comprising:

a flexible heat-resistant sheet having first and second ends, the flexible sheet being in the form of a laminate having an outer and an inner layer, the outer layer being formed of metal and the inner layer which in use of the apparatus contacts the exhaust box or pipe being formed of a gasket material, the outer layer having first and second side edge portions extending between the said first and second ends and beyond the gasket material, each said side edge portion being formed with a plurality of slots extending substantially parallel to the first and second ends of the flexible sheet to form a plurality of tabs arranged along the side edge portions, which tabs conform to changes of curvature when the flexible sheet is secured in place in use of the apparatus of the pipe or box; and fastening means for securing the flexible sheet in place when the sheet is wrapped around the exhaust box or pipe so that a seal is provided between the sheet and the exhaust box or pipe, the fastening means comprising:

first and second fastening members, the first fastening member comprising an elongate fastening strip having a first end and a second end and being formed along its length with a plurality of substantially parallel recesses or slots and the second fastening member comprising a body for receiving the fastening strip, the body having a rotatable screw-threaded portion which engages the slot when the fastening strip is received in the body and the body carrying an elongate connection member having a free end extending from the body, the free end of the elongate connection member and the first end of the fastening strip each being shaped so as to have a narrow neck portion defining a relatively large end portion;

a first receiving member in the form of a metal plate secured to the outer layer of the flexible sheet adjacent one end thereof, the first metal plate having a cut-out plate extending away from the first edge of the flexible sheet, the cut-out portion having first and second opposed edge portions which are raised to define a recess for receiving the end portion of the fastening strip; and a second receiving member in the form of metal plate secured to the outer layer of the flexible sheet adjacent the other end thereof, the second metal plate having a cut-out portion extending away from the second edge of the flexible sheet, the cut-out portion having first and second opposed edge portions which are raised to define a recess for receiving the end portion of the connection member.

* * * * *